US005429254A

United States Patent [19]

Christine

[11] Patent Number: 5,429,254

[45] Date of Patent: Jul. 4, 1995

[54] ASEPTIC INFANT FEEDING SYSTEM

[75] Inventor: William C. Christine, Nazareth, Pa.

[73] Assignee: Inpaco, Worthington, Ohio

[21] Appl. No.: 111,295

[22] Filed: Aug. 24, 1993

[51] Int. Cl.[6] ..... A61J 9/00

[52] U.S. Cl. ..... 215/11.1; 220/403; 220/465; 222/105

[58] Field of Search ..... 215/11.1, 11.2, 11.3; 220/403, 404, 410, 465, 740; 222/105, 490, 95

[56] References Cited

U.S. PATENT DOCUMENTS

| | | | |
|---|---|---|---|
| 2,859,891 | 11/1958 | Carkin . | |
| 3,061,129 | 10/1962 | Fitz Gerald . | |
| 3,346,133 | 10/1967 | Herdman | 215/11.1 |
| 3,704,803 | 12/1972 | Ponder | 215/11.4 X |
| 4,420,100 | 12/1983 | Mueller | 215/11.3 X |
| 4,466,547 | 8/1984 | Klittich . | |
| 4,533,057 | 8/1985 | Klittich . | |
| 4,637,934 | 1/1987 | White | 215/11.1 X |
| 4,821,896 | 4/1989 | Cheng . | |
| 4,944,418 | 7/1990 | Wallace . | |
| 5,248,066 | 9/1993 | Olsen et al. | 222/105 |

*Primary Examiner*—Allan N. Shoap
*Assistant Examiner*—Christopher J. McDonald
*Attorney, Agent, or Firm*—Hill, Steadman & Simpson

[57] ABSTRACT

A system is provided for housing a feeding product having an exterior body defining an interior, an interior chamber within the exterior body and a fitment extending from the interior chamber through an opening of the exterior body. A teat assembly is secured about the opening of the exterior body providing access to the feeding product within the interior chamber. The exterior body may be selectively accessed for removal of the interior chamber for disposal and/or replacement thereof. The exterior body may be reused repetitively by replacing the interior chamber with a new chamber containing product.

15 Claims, 3 Drawing Sheets

ASEPTIC INFANT FEEDING SYSTEM

BACKGROUND OF THE INVENTION

The present invention generally relates to an infant feeding system. More specifically, the invention relates to a feeding system to provide a sterile fluid enteral feeding product using the fewest possible disposable items.

Of course, nursing bottles are generally known for feeding an infant. Typically, such bottles include a compartment having an interior and a teat which secures to an opening of the compartment. Normally the teat is interconnected with a cap which threadably secures to a threaded open end of the container. Such containers, however, do not initially provide a sterile environment for the product contained within the container. That is, the interior of the container, as well as the cap and teat, must be sterilized before each usage of the bottle as well as between uses.

Nursing bottles have, therefore, been developed having an interior bag-like container within an exterior housing. Such nursing bottles, however, require an additional opening mechanism to be included on the exterior container. More specifically, removal of the interior bag-like container is required from the exterior container for replacement thereof. A number of systems have been proposed, such as in U.S. Pat. Nos. 2,859,891; 4,466,547; 4,533,057; and 4,821,896.

U.S. Pat. No. 2,859,891 to Carkin relates to a nursing bottle comprising a rigid flask composed of hinged sections which can be separated to enable thorough cleansing and sterilizing of the flask. A thin, flexible, generally plastic container in the flask can be removed therefrom and replaced. However, the device has the disadvantage that opening and closing of the outer compartment requires positive connection and disconnection of latches. Furthermore, the hinges and latches project from the exterior walls of the container which can be dangerous if the bottle is, for example, dropped by an infant or other user.

Moreover, the neck of the interior container must protrude from the opening of the exterior container and then folded down over the neck of the exterior container. The collar and nipple are then threadably connected to the neck of the exterior container. As a result, leakage frequently occurs when such a system is used since the threadable connection of the neck of the exterior container may tear the neck of the interior container. Still further, leakage may occur between the collar and neck even without tearing of the interior container due to a poor seal formed therebetween.

U.S. Pat. No. 4,466,547 to Klittich relates to a baby feeding bottle having an open-ended, disposable, flexible and collapsible bag-like container mountable in a reusable tubular housing. The baby feeding bottle requires cooperating clamp formations of tongue and groove form presenting mating, screw-threaded clamping surfaces between which an engagement formation of the interior container may be nipped. Furthermore, the interior container of the bottle includes tab formations for extending around the externally threaded open neck of the housing. Therefore, leakage may result after a collar or locking ring is positioned over a teat and screwed onto the externally threaded neck of the exterior housing.

U.S. Pat. No. 4,533,057 to Klittich relates to a feeding bottle including a tubular housing which is constructed from two halves defined by a hinge zone extending longitudinally along the length of the housing. Releasably interengageable catch elements are provided on the housing halves to permit the halves to be securely locked together in their closed position. Each catch element comprises a resilient, plate-like element with an aperture therethrough in which the associated tapered catch element is releasably engageable to lock the housing halves together in their closed position. The resiliency of the catch elements allows the separate elements to be disengaged from each other and allows the housing halves to be opened.

Similar to Carkin, the bottle of Klittich '057 provides an irregular exterior surface of the container which houses the disposable interior container. Also, the interior container includes a neck which extends over the opening and about the neck of the exterior container on which the locking ring, teat and cap are secured which increases the chances for leakage.

U.S. Pat. No. 4,821,896 to Cheng relates to a nursing bottle with a liner and vent. The bottle includes male threads formed on an outer bottom surface and a hollow protrusion extending inwardly from a base of the bottle toward the interior of the bottle. The interior disposable liner bag includes a reinforced wall with a cut positioned at its center to match the structure of the base of the feeding bottle. The resultant nursing bottle, therefore, requires significant interaction for replacement of the interior container of the bottle and alignment of the base of the bottle with the interior container.

A need, therefore, exists for an improved infant feeding system which overcomes the deficiencies of the prior art.

SUMMARY OF THE INVENTION

The present invention provides a system for providing a feeding product to an individual. To this end, in an embodiment, the invention provides an exterior body defining an interior including a hinged edge for selective access to the body. An interior chamber houses the feeding product wherein the chamber includes an opening which is connected to a fitment. The fitment has a first end which connects at an opening of the body and a second end providing fluid communication with the opening of the interior chamber. A teat assembly is secured to the opening of the body by a collar and further includes a teat for delivering the feeding product to a user.

In an embodiment, the fitment includes a seal for enclosing the opening prior to connection to the teat assembly.

In an embodiment, the teat assembly includes a casing having a peelable seal for enclosing the assembly prior to use.

In another embodiment, the invention provides a chamber for containing a feeding product having at least one layer of film which forms an interior compartment for receiving the feeding product. A fitment extends into the interior compartment having a channel providing fluid communication with the interior compartment wherein the film is sealed after receiving the feeding product in at least a portion of the channel of the fitment.

In an embodiment, the film includes an inert sealant layer, a polypropylene outer layer, and a polymer layer that provides barrier properties.

In a further embodiment, the present invention provides a method for preparing a feeding product for dispensing to a user by: providing an exterior shell defining an interior compartment capable of selective access thereto; providing a sealed disposable container containing the feeding product and further including a channel in communication with the feeding product; accessing the interior compartment of the shell; inserting the container in the interior compartment such that the channel extends through an opening in the shell; and attaching a dispensing means to the opening of the shell for delivery of the feeding product.

In an embodiment, the opening of the shell is threadably connected to the dispensing device to form a seal therebetween.

In an embodiment, the interior compartment is accessed by a living hinge of the shell.

In an embodiment, the exterior shell is constructed from polypropylene.

In an embodiment, the container is constructed from a multi-layer film.

It is, therefore, an advantage of the present invention to provide an infant feeding system for containing a sterile fluid enteral feeding product.

A further advantage of the present invention is to provide an exterior container of the feeding system which is substantially smooth on the entirety of the exterior.

A still further advantage of the feeding system is to provide a simple system for removal and replacement of an interior container within the exterior container.

Moreover, an advantage of the present invention is to provide the fewest number of disposable items for the infant feeding system.

Yet another advantage of the infant feeding system is to provide a leak-free system when being used.

Moreover, the present invention provides a simple method for replacement of the interior compartment containing the enteral feeding product into the exterior container.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention relates to an aseptic infant feeding system having an exterior container which may be open for selective access to an interior container having an enteral feeding product therein. The interior container is connected to a fitment which is further connected to a teat assembly for connection to a neck of the exterior container. As a result, the interior container may be replaced upon depletion or partial depletion of the interior container.

Figure 1:
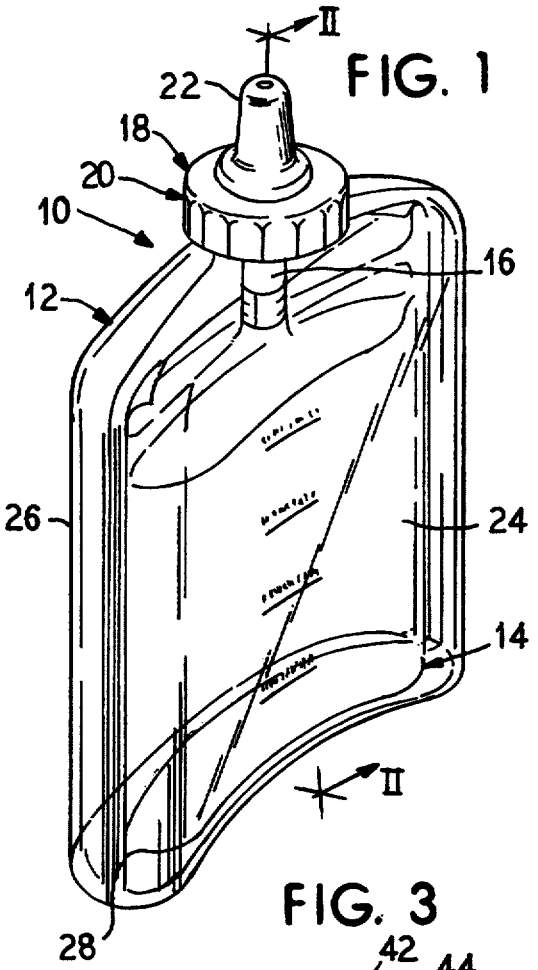
FIG. 1 is a perspective view of an embodiment of an infant feeding system of the present invention.

Referring now to the drawings, FIG. 1 generally illustrates an aseptic infant feeding system 10. The system 10 has a reusable holder 12 forming an exterior compartment for an interior pouch 14. The pouch 14 may be connected to a fitment 16 in a sealed relationship. The fitment 16 extends to mate in a sealed relationship with a teat assembly 18 which includes a collar 20 and a teat 22. Other teat assemblies or attachments to the holder 12 are, of course, contemplated, such as, for example, a collar which can be snap-fit on a neck of a holder. Alternatively, a remote connecting member, such as a hose connection, may be connected at the neck of the holder for remote feeding which may further require use of a pump (not shown).

In a preferred embodiment, the holder 12 may have a slightly concave exterior wall 24 and a slightly convex exterior wall 26 which meet at a longitudinal hinge 28 formed along one side wall of the holder 12. The exterior surface of the holder 12 may be manufactured by an injection molding process. In the preferred embodiment, a polymer, such as polypropylene, may be molded to form the holder 12. As a result, a lightweight, conveniently shaped holder 12 is formed. The holder 12 may, therefore, be easily held and handled either by an infant using the system 10 or by an individual replacing the interior pouch 14.

The hinge 28 is, preferably, a living hinge or self-hinge which provides for self-latching of the exterior holder 12, as well as unlatching thereof. Although the holder 12, as shown, is constructed from the concave exterior wall 24 and the convex exterior wall 26, other resultant exterior shapes are contemplated for providing simple holding and handling of the system 10, such as the holder illustrated in FIG. 6.

Figure 2:
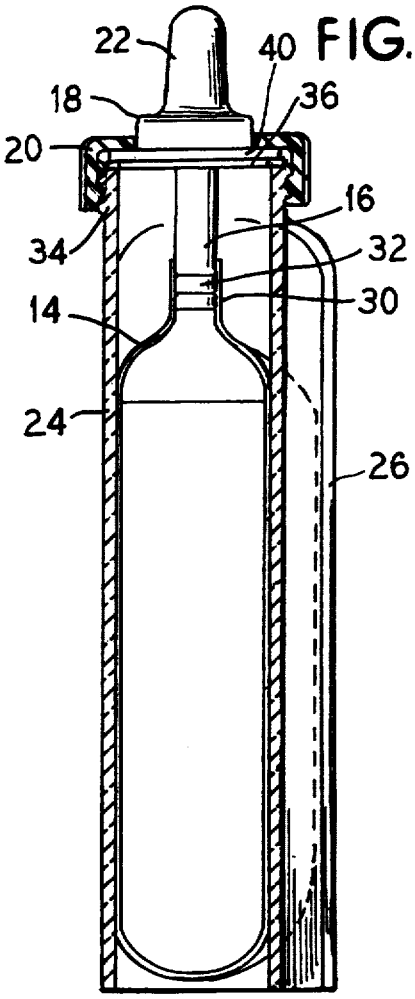
FIG. 2 is a cross-sectional view of the feeding system taken generally along the line II—II of FIG. 1.

As more clearly illustrated in FIG. 2, the pouch 14 has a neck 30 which extends over the fitment 16. One end 32 of the fitment 16 has slightly ridged surfaces for simple, friction fitting of the end 32 in the neck 30 of the pouch 14. A sealed, leak-free relationship between the end 32 of the fitment 16 and the neck 30 of the pouch 14 results. The fitment 16 may be pre-sterilized by a gamma irradiation process prior to assembly of the neck 30 of the pouch 14 onto the end 32 of the fitment 16.

The open end of the holder 12 may have an exterior threaded portion 34 for securing the interior threaded collar 20 in a sealed relationship about the end of the holder 12. The fitment 16 further includes a connector 36 opposite the end 32 having substantially the same diameter as the open end of the holder 12. The connector 36, therefore, is placed on the open end of the holder 12 to cover and seal the same. The opposite end 32 of the fitment 16 extends into the interior body of the holder 12. An interior channel 38 (shown in FIG. 5) extends through the body of the fitment 16 such that fluid from the pouch 14 may flow therethrough.

The teat assembly 18 further includes a flat surface 40 within the collar 20. A base for the teat 22 is formed by the flat surface 40 which substantially mates with the connector 36 of the fitment 16. The connector 36 of the fitment 16 and the surface 40 of the teat assembly 18 provide a sealed relationship therebetween for fluid being dispensed from the pouch 14 through the teat 22.

Figure 3:
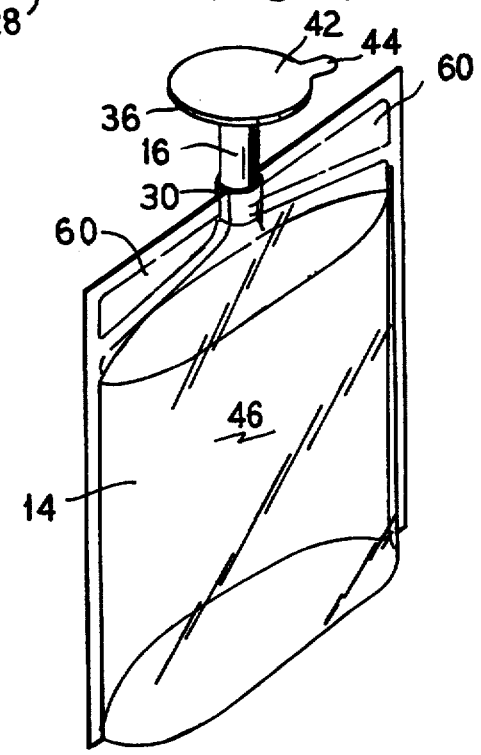
FIG. 3 is a perspective view of an embodiment of an interior container, fitment and closure of the feeding system of the present invention.

Referring now to FIG. 3, the pouch 14 is generally shown. The fitment 16 extends into the pouch to provide fluid communication therebetween. The fitment 16 and the connector 36 may be sealed by a closure 42. The closure 42 has a tab 44 for removal of the closure 42 by peeling of the tab 44 from the connector 36. The pouch 14 may be constructed and formed from a variety of materials. Preferably the pouch is constructed from a flexible plastic material such as a multi-layer film. For example, in a preferred embodiment, the pouch 14 may consist of an inert sealant layer which is supported by a (printable) polypropylene outer layer on a barrier polymer. However, a variety of flexible films can be used.

To form the feeding system 10, the film of the pouch 14 may be sterilized in-line and formed. Then, the fitment 16 may have feeding product 46 added by filling of the pouch 14. The pouch 14 may then be sealed on any sides which were not previously sealed when formed resulting in a completely sealed and enclosed pouch 14.

The pouch 14 can be manufactured in an aseptic vertical form-fill-seal system wherein the fitment 16 is added after forming the pouch 14 and prior to filling the pouch 14 with the feeding product 46. The fitment 16 can, therefore, be sealed in the pouch 14 forming a neck 30 at the opening of the pouch 14.

Figure 4:
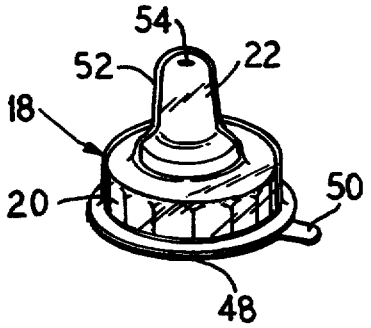
FIG. 4 is a perspective view of an embodiment of a teat assembly for the feeding system of the present invention.

FIG. 4 illustrates the teat assembly 18 previously 10 described, but further illustrates an additional closure 48 with tab 50 sealing an open end of a thermal-formed package 52. The teat assembly 18 is, therefore, sterilized, enclosed and ready for use upon delivery within the sealed package 52. To use the teat assembly 18, the tab 50 may be pulled by a user preparing the feeding system 10 to remove the closure 48 resulting in removal of the closure 48 and the package 52 from around the teat assembly 18.

The collar 20 of the teat assembly 18 includes interior threads for locking to the holder 12. Furthermore, the collar 20 can have slight indents about its exterior periphery for easy gripping of the collar 20 when securing to the holder 12 or when removing the collar 20 therefrom. The teat 22 includes an opening 54 at its extreme end for the feeding product 46 to flow therethrough into, for example, a mouth of an infant.

Figure 5:
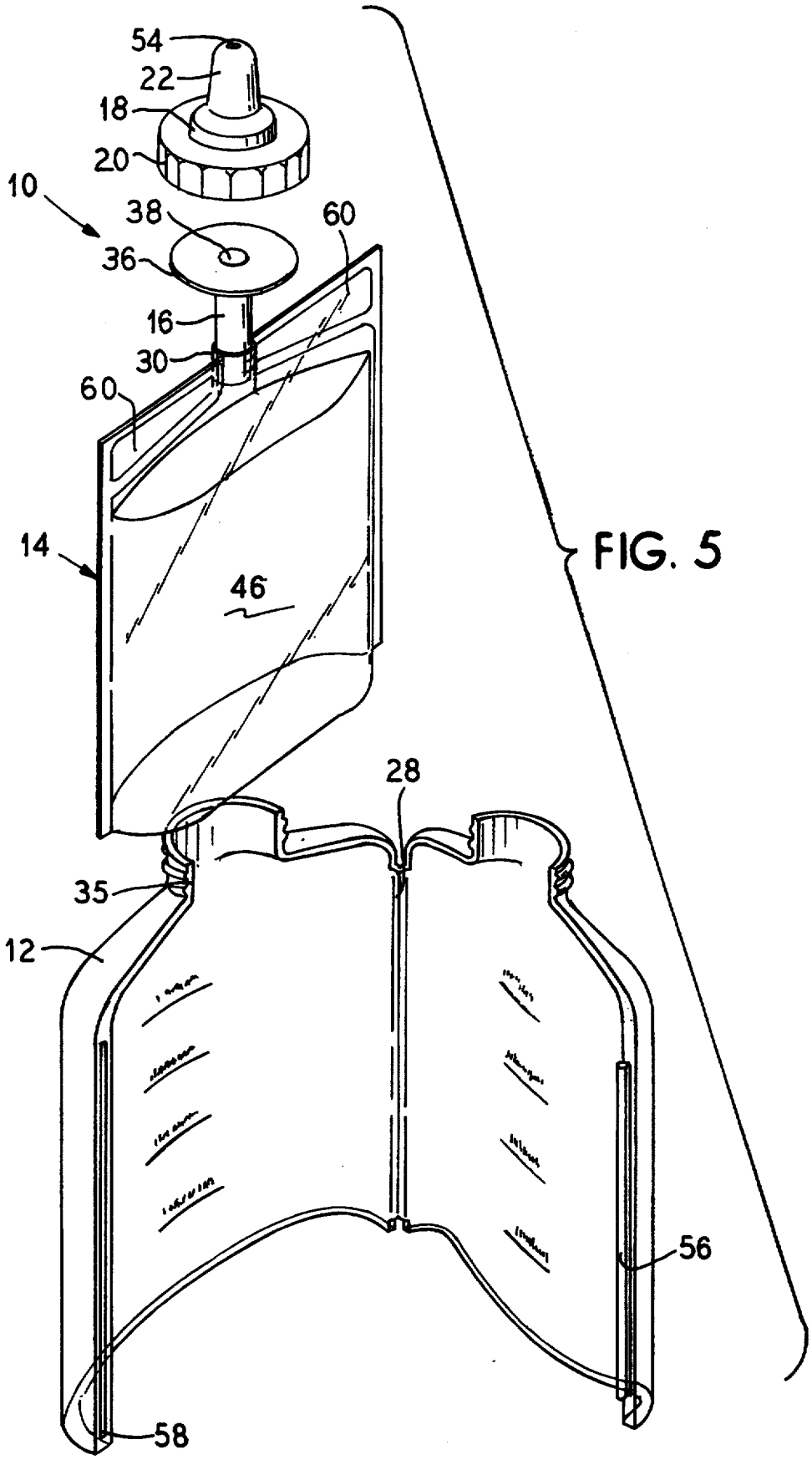
FIG. 5 is an exploded assembly view of the components for the feeding system of the present invention.

FIG. 5 illustrates an exploded view of the unassembled components of the system 10. The holder 12 is shown in an open position for receiving the pouch 14. The hinge 28 is, therefore, contracted to maintain the holder in the open position. Opposite the hinge 28 is an engaging portion 56 which is press fit into a receiving portion 58. Both the engaging portion 56 and the receiving portion 58, as well as the hinge 28, are formed such that the exterior of the holder 12 is substantially smooth with no projecting connecting parts. The hinge 28 is constructed to maintain the open position or closed position of the holder 12 as desired.

As further shown in FIG. 5, the closure 42 of the fitment 16 has been removed. In addition, the closure 48 and the package 52 has been removed from around the teat assembly 18. The pouch 14 can further include sealed areas 60 extending from the neck 30 providing an area which extends within the interior of the holder 12 corresponding to the portion of the fitment 16 extending into the pouch 14 at the neck 30. The pouch 14 can then be inserted into the holder 12 such that a neck portion 35 of the holder 12 closes immediately below the connector 36 of the fitment 16 and above the neck 30 of the pouch 14. The connector 36, therefore, rests on the top circumferential edge of the neck portion 35 when the pouch 14 is inserted into the holder 12, and the holder 12 is then closed.

Prior to use, the closure 42 of the fitment 16 and the closure 48 of the teat assembly 18 are generally removed to provide communication from the interior of the pouch 14 through the teat 22 to the mouth of the user for feeding. The teat assembly 18 can then be secured about the threaded neck portion 35 by securing the collar 20 of the teat assembly 18 about the threaded neck portion 35. This results in sealing of the connector 36 of the fitment 16 to the interior flat surface 40 of the teat assembly 18 by pressure of the collar 20 resulting from secure attachment of the same.

The assembled system 10 may now be used to feed an infant or other person or animal. When the feeding product 46 within the pouch 14 is depleted or partially depleted, the holder 12 may be opened for removal and/or disposal of the pouch 14 and/or the fitment 16. The package 52 for the teat assembly 18 can, of course, be saved for storage of the teat assembly 18 for reuse. As a result, sterile product may be provided for the system 10 for delivery to an individual. Following use, only the pouch 14 itself requires disposal prior to reuse of the system 10.

An alternate embodiment of an infant feeding system 100 is generally illustrated in FIGS. 6–11. The system 100 has a reusable holder 102 forming an exterior compartment for an interior pouch 104 as partially shown in FIG. 7.

Figure 6:
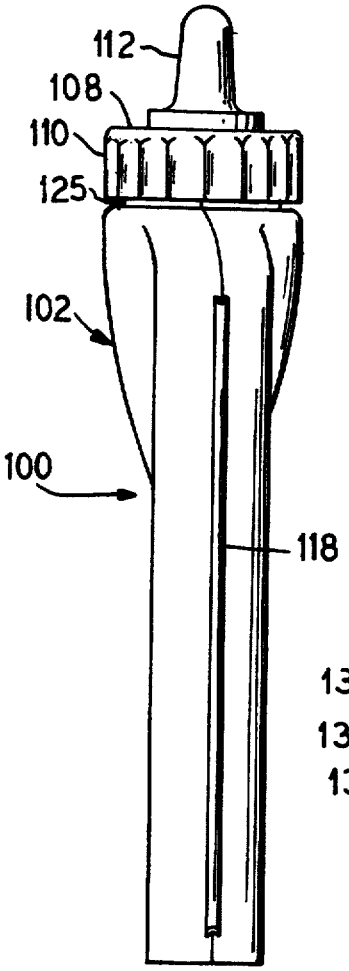
FIG. 6 is a perspective view of another embodiment of the infant feeding system of the present invention.
Figure 11:
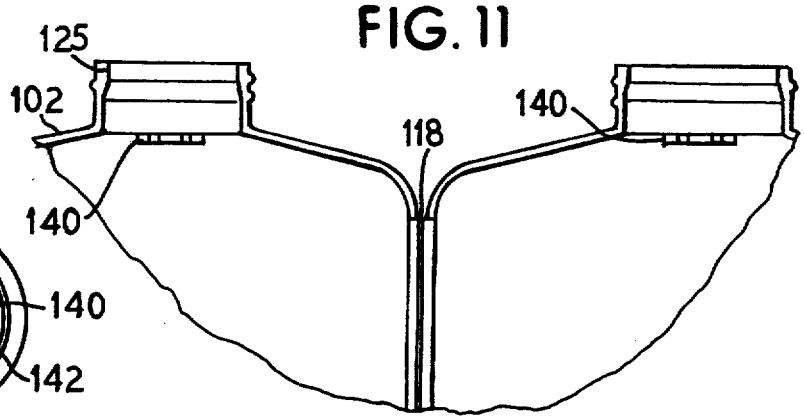
FIG. 11 is a partial plan view of the embodiment of the feeding system of FIG. 6 in an open position.

In the embodiment illustrated in FIG. 6, the holder 102 may have a substantially smooth exterior wall which widens prior to a neck portion 125 of the holder 102 which connects to a teat assembly 108. The exterior surface of the holder 102 meets at a longitudinal hinge 118 (as shown in FIGS. 6 and 11) formed along one side wall of the holder 102. The exterior surface of the holder 102 may be manufactured by an injection molding process. In the preferred embodiment, a polymer, such as polypropylene, may be molded to form the holder 102. Like the holder 12 illustrated in FIG. 1, the holder 102 of FIG. 6 may be easily held and handled either by an infant using the system 100 or by an individual replacing the interior pouch 104 from the holder 102.

The hinge 118 is, preferably, a living hinge or self-hinge which provides for self-latching of the exterior holder 102, as well as unlatching thereof. The latching may be secured by an engaging portion 146 which is press fit into a receiving portion 148. The latching extends longitudinally along the exterior of the holder 102 opposite the hinge 118. In an alternative embodiment, latching is provided by snapping or clasping of the longitudinal side opposite the hinge 118.

Figure 7:
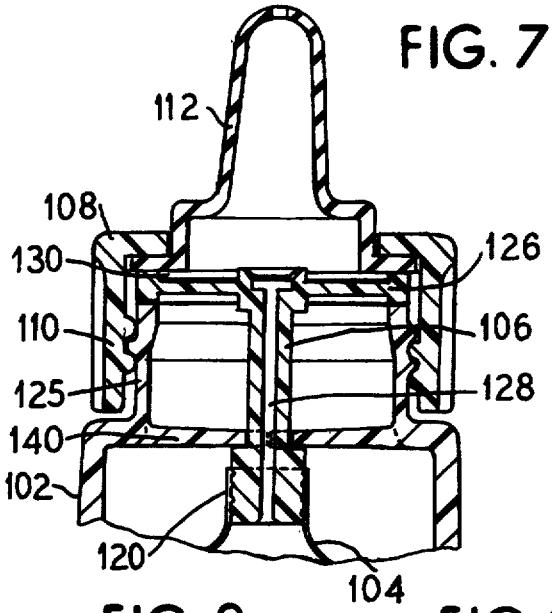
FIG. 7 is a partial cross-sectional view of the infant feeding system taken generally along the line VII—VII of FIG. 6.

Referring to FIG. 7, a fitment 106 extends to mate in a sealed relationship with a teat assembly 108 which includes a collar 110 and a teat 112. The collar 110 shown in FIG. 7 is threadably attached to the neck portion 125 of the holder 102, but, of course, other attachments between the holder 102 and the teat assembly 108 are contemplated.

As further illustrated in FIG. 7, the pouch 104 has a neck 120 which extends over the fitment 106. One end 122 of the fitment 106 has a ribbed section for securing of the pouch 104 to the fitment 106. A sealed and leak-free relationship between the end 122 of the fitment 106 and the neck 120 of the pouch 104 results.

Figure 9:
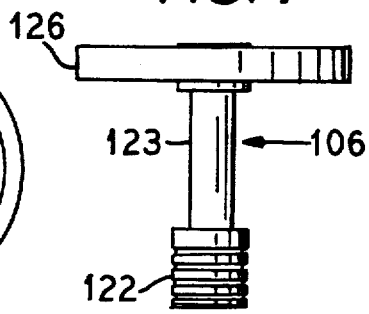
FIG. 9 is a plan view of another embodiment of a fitment for the feeding system of the present invention.

As illustrated in FIGS. 7 and 9, the fitment 106 includes a connector 126 opposite the end 122 having substantially the same diameter as the open end of the holder 102. The connector 126 of the fitment 106 may, therefore, be placed on the open end of the holder 102 to cover the same. The opposite end 122 of the fitment 106 extends into the interior body of the holder 102. An interior channel 128 extends through an exterior body 123 of the fitment between the connector 126 and the end 122 such that fluid from the pouch 104 may flow therethrough.

Figure 8:
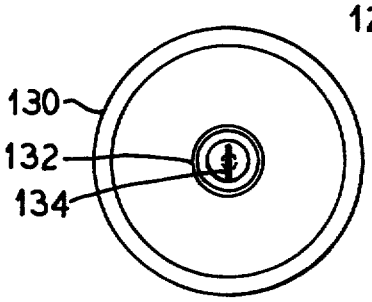
FIG. 8 is a plan view of a seal including a check valve for the infant feeding system of the present invention.

After the fitment 106 is in place on the holder 102, a check valve 130 generally illustrated in FIG. 8 may be heat sealed to cover the connector 126. The check valve 130 includes a central portion 132 aligned with the interior channel 128 of the connector 126 such that a slit 134 may be cut into the valve 130 prior to use. A thermoplastic elastomer may be injection molded and heat sealed to a polyolefin film for implementation of the check valve 130. After the slit 134 is cut and upon application of suction on the teat 112, fluid may be withdrawn from the pouch 104 of the holder 102. The check valve 130, therefore, is similar to the closure 42 of FIG. 3. However, the check valve 130 is not removed as required for the closure 42 for use of the system illustrated in FIGS. 1–5.

The feeding system 100 illustrated in FIGS. 6–11 may be formed in the same manner described with reference to FIGS. 1–5. Similarly, the pouch 104 of the feeding system 100 may be filled by the same method described with reference to FIGS. 1–5.

Figure 10:
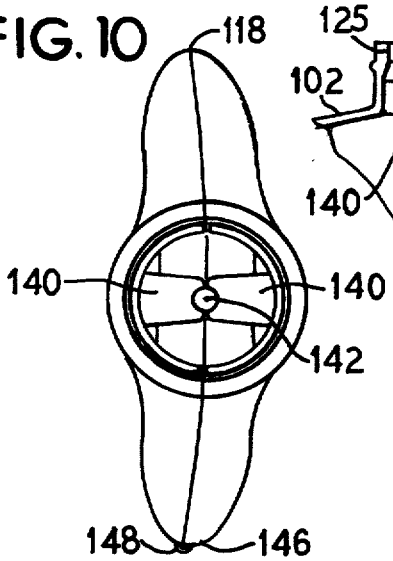
FIG. 10 is a top plan view of the infant feeding system of FIG. 6 with the teat assembly removed therefrom.

FIGS. 10 and 11 illustrate a clip 140 within or near the neck portion 125 of the holder 102. The clip 140 secures the body 123 of the fitment 106 in position when the fitment 106 is placed so as to extend into the holder 102. The clip 140 may be formed by horizontal extensions into the neck portion 125 of the holder 102.

As illustrated in FIG. 10, each portion of the clip 140 extends to a point substantially mating with the other clip and are slightly indented to form an opening 142 through which the body 123 of the fitment 106 extends. The clips 140 secure the body 123 of the fitment 106 at a point between the end 122 and the connector 126.

Referring to FIG. 11, the clips 140 extend from the base of the neck portion 125 into the interior of the holder 102. The clips 140 are substantially equidistantly positioned from the opening of the holder 102. The fitment 106 may, therefore, be positioned such that the body 123 of the fitment 106 midway between the connector 126 and the end 122 is secured by the opening 142 formed by the clips 140 when the holder 102 is closed for use.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system for dispensing a feeding product, the system comprising:

a body defining an interior including a hinge allowing selective access to the body, wherein the body when in a closed position, has an opening providing access to the interior;

a container housing the feeding product to be dispensed including an opening for accessing the feeding product, the container constructed and arranged to allow the container to be located in the interior when the body is in the closed position;

a fitment having a first end enclosing the opening of the body and a second end extending into the opening of the container and providing fluid communication with the opening of the container; and a feeding connector having a collar allowing the feeding connector to be secured to the opening of the body and a teat allowing delivery of the feeding product from the container to a user.

2. The system of claim 1 further comprising:

a seal selectively removable from the fitment and enclosing the opening of the body.

3. The system of claim 1 further comprising:

a removable casing having a peelable seal enclosing the connector.

4. The system of claim 1 wherein the body has a substantially smooth exterior surface.

5. The system of claim 1 further comprising:

a channel in the fitment which extends into the opening of the body and the opening of the container between the first end and the second end.

6. The system of claim 1 wherein the container is disposable.

7. The system of claim 1 wherein the container is removably secured in the interior of the body.

8. The system of claim 1 further comprising:

a valve operatively connected to the fitment capable of selectively accessing the feeding product in the container.

9. The system of claim 1 further comprising:

a clip securing the fitment in the body.

10. The system of claim 1 wherein the second end of the fitment is ribbed.

11. The system of claim 1 further comprising:

a valve constructed and arranged to maintain a seal in the container prior to use.

12. A body for housing a container in a closed position having a height approximately equal to its width and further having a feeding product therein, the body comprising:

a shell defining an interior having a non-circular cross-sectional area along its length so as to receive the container therein;

a hinge allowing selective access to the interior of the shell;

an opening in the shell providing access to the interior when the shell is in the closed position; and clips projecting into the interior of the shell at the opening.

13. The body of claim 12 further comprising:

a neck extending from the shell forming the opening for attaching a dispensing means.

14. The body of claim 12 wherein the hinge is a living hinge.

15. The body of claim 12 wherein the shell has a substantially smooth exterior surface when in the closed position.

* * * * *